United States Patent [19]

Yoneda et al.

[11] Patent Number: 5,038,685

[45] Date of Patent: Aug. 13, 1991

[54] TRACK APPARATUS FOR A TOY RACING CAR

[75] Inventors: Yousuke Yoneda; Masami Furukawa, both of Tokyo, Japan

[73] Assignee: Tomy Company, Ltd., Tokyo, Japan

[21] Appl. No.: 524,720

[22] Filed: Apr. 20, 1990

Related U.S. Application Data

[63] Continuation of Ser. No. 295,398, Jan. 10, 1989, abandoned.

[30] Foreign Application Priority Data

Dec. 23, 1988 [JP] Japan ..... 63-166680[U]

[51] Int. Cl.[5] ..... A63G 7/00

[52] U.S. Cl. ..... 104/54; 104/60; 238/10 A

[58] Field of Search ..... 104/54, 60, 79, DIG. 1; 238/10 R, 10 F, 12, 10 A; 446/444, 446; 267/275, 15.5

[56] References Cited

U.S. PATENT DOCUMENTS 1,551,002 8/1925 Beck ..... 104/79
2,755,500 7/1956 Floehr ..... 267/155
2,815,872 12/1957 Graham ..... 104/79
4,185,409 1/1980 Cheng ..... 104/79

FOREIGN PATENT DOCUMENTS 1305466 4/1987 U.S.S.R. ..... 267/155
1508959 4/1978 United Kingdom .

*Primary Examiner*—Douglas C. Butler
*Assistant Examiner*—Mark T. Le
*Attorney, Agent, or Firm*—Staas & Halsey

[57] ABSTRACT

A track apparatus for a toy racing car includes a car-entry track portion, a car-exit track portion, and a pivotal arm pivotally mounted between the two track portions to carry a car from one portion to the other. The pivotal arm has a stand connected to a distal end thereof which has a retractable stop. When a car travelling with sufficient momentum hits the stop, the pivotal arm is caused to pivot from one position to another, whereby the car is delivered from the car-entry track portion to the car-exit track portion. Upon reaching the second position, the stop is automatically retracted to release the car.

22 Claims, 3 Drawing Sheets

TRACK APPARATUS FOR A TOY RACING CAR

This is a continuation of copending application Ser. No. 07/295,398 filed on 1/10/87, abandoned.

BACKGROUND OF THE INVENTION

1. Field of the Invention

The present invention relates generally to a track or rail apparatus of a racing car toy which enables a toy racing car to jump.

2. Description of the Related Art

Slot car apparatuses are generally well known for racing toy cars around a laid out course. The racing car uses a motor fed by conductive lines provided in or adjacent the slot of the track. This type of car is not suitable for jumping since, when the car leaves the track, the motor looses its power source.

Another type of toy racing car has been developed wherein the racing car inertially jumps over the gap between two track segments which are spaced apart at a given interval. It is still very difficult to enable the racing car to jump to the opposite track segment and run thereon because the jumping car is inclined by the inertia of the car motor, that is, the force of stopping the car abruptly.

SUMMARY OF THE INVENTION

An object of the present invention is to provide a toy racing car and track apparatus in which the car is capable of jumping between two track segments without experiencing the problems aforementioned.

This and other objects of the invention are met by providing a track apparatus for a toy racing car which includes a track support body forming an entry-car track portion and an exit-car track portion, the two portions being sloped in opposite directions and being spaced at a given interval and having aligned ends which oppose each other, and a rotating arm pivotally supported between the two portions and being biased by a return spring to be normally juxtaposed to the entry-car track portion. The rotating arm includes magnetic materials on the top surface, a stopper to be engaged with or disengaged from the racing car in a manner to allow it to vertically move, and a stand formed to be in the same level as the car-entry and car-exit track portions when the rotating arm is rotated.

The racing car comes from the car-entry track portion to the stand connected to the end of the car-entry track portion and then stops. The rotating arm supporting the stand is inertially rotated to the car-exit track portion side. When the stand comes into contact with the end of the car-exit track portion, the stopper is moved downwardly in a manner to allow the racing car to enter the car-exit track portion.

These objects, together with other objects and advantages which will be subsequently apparent reside in the details of construction and operation of the apparatus as more fully hereinafter described and claimed, reference being had to the accompanying drawings forming a part hereof, wherein like reference numerals refer to like parts throughout.

DETAILED DESCRIPTION OF THE PREFERRED EMBODIMENTS

Figure 1:
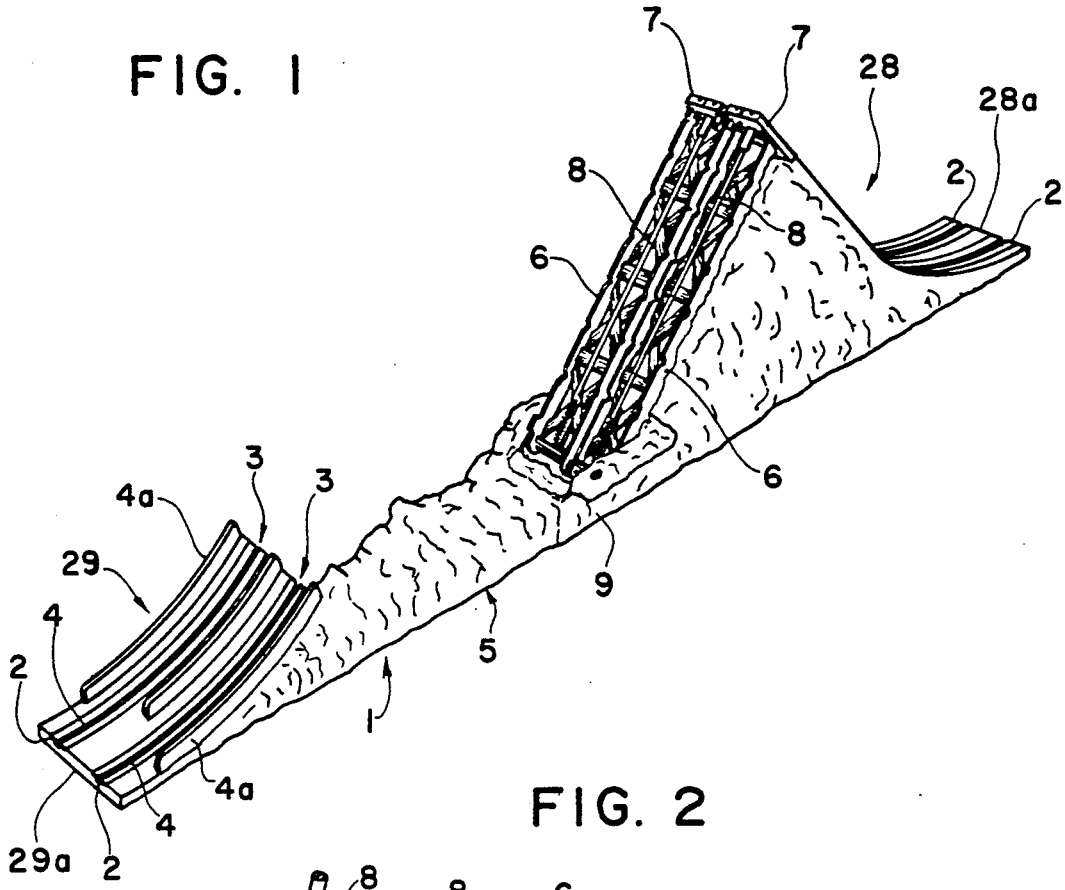
FIG. 1 is a perspective view showing a first preferred embodiment of the track apparatus according to the present invention.

As shown in FIG. 1, a track support body 1 which rests on a planar surface such as a table top or floor when the apparatus is in use includes a car-entry track portion 28 and a car-exit track portion 29 at the opposite ends of the body 1. The track portions are oppositely sloped to form take-off and landing ramps with a jumping path defined continuously therebetween. Each track portion 28 and 29 has two separate, parallel car paths, each being provided with a centrally disposed slot 4 having an associated conductor, as is typical and well known for "slot cars". Guide rails 4*a* are disposed on opposite sides of the slots 4 on the car-exit track portion 29 to help guide the cars into their respective slots.

End 29*a* of car-exit track portion 29 and end 28*a* of car-entry track portion 28 are connectable to a circular or otherwise shaped track (not shown) so as to form a segment of a race track. Connectors are not illustrated since these are well known and do not form a part of the present invention.

A base portion 5 of the track support body 1 is shaped to resemble a mountain, and the track portions 28 and 29 conform to the shape of the mountain. The sloped surface of the car-entry track portion 28 is longer and has a larger gradient than track portion 29. Also, the upper end of track segment 28 is higher than the upper end of track segment 29. The inner ends of the track portions oppose each other and are spaced apart at a selected interval.

Figure 2:
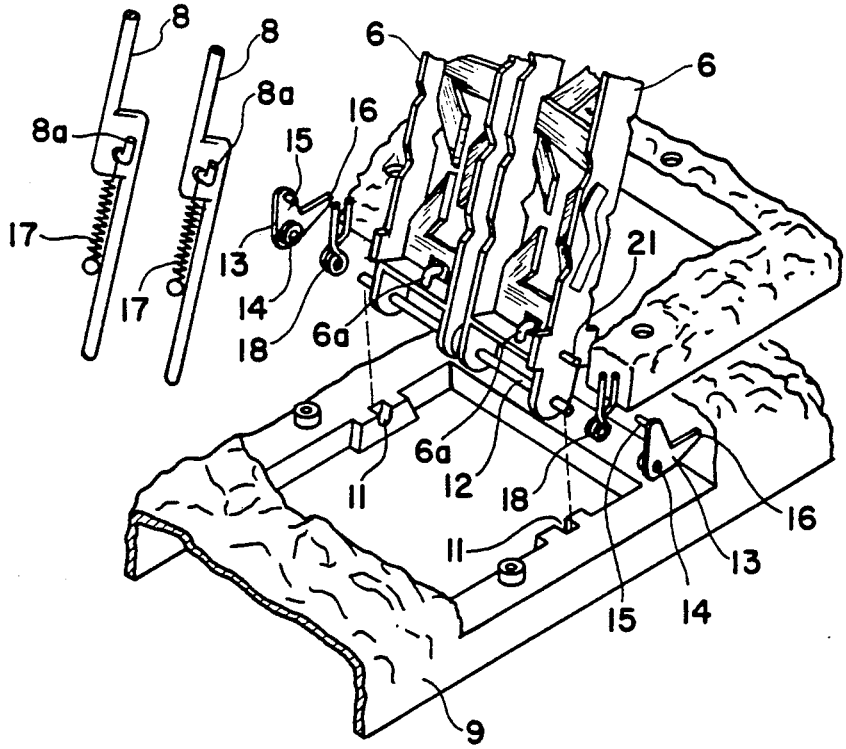
FIG. 2 is an enlarged, partial exploded view of a portion of the embodiment of FIG. 1.

The base portion 5 includes a supporting section on the car-entry track portion 28 side thereof which, as shown in FIG. 2, has bearings 11 integrally formed therein which support opposite ends of a shaft 12. The shaft 12 pivotally supports the proximal ends of two, side-by-side pivotal arms 6. A pair of coil springs 18 are fitted on opposite end portions of the shaft 12 between outer sides of the pivotal arms 6 and inner sides of L-shaped levers 13 pivotally supported on opposite ends of the shaft 12. Each lever 13 has a bearing aperture 14 for receiving the opposite ends of the shaft 12.

Figure 5:
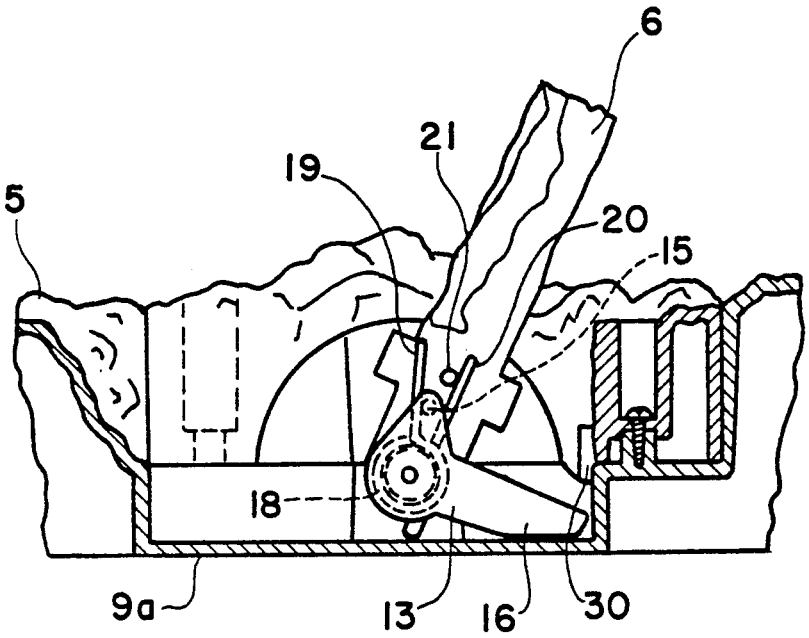
FIG. 5 is a partial sectional view showing the supporting structure for the pivoting arm of the embodiment of FIG. 1.

Stands 7 are mounted on the distal ends of the pivotal arms 6. When the stands 7 contact the car-entry track portion 28 as shown in FIG. 1, one end 20 (as seen in FIG. 5) of the coil spring 18 comes into contact with a pin 21 provided on the proximal end of each pivotal arm 6, and the other end 19 of the coil spring 18 comes into contact with a pin 15 provided on the lever 13. A projecting portion 16 of the lever 13 contacts a bottom plate 9*a* of the supporting structure 9. The pivotal arm 6, therefore, is forced to rotate counterclockwise as shown in FIG. 5 and can easily pivot when a racing car 26 moves onto the stand 7.

Figure 3:
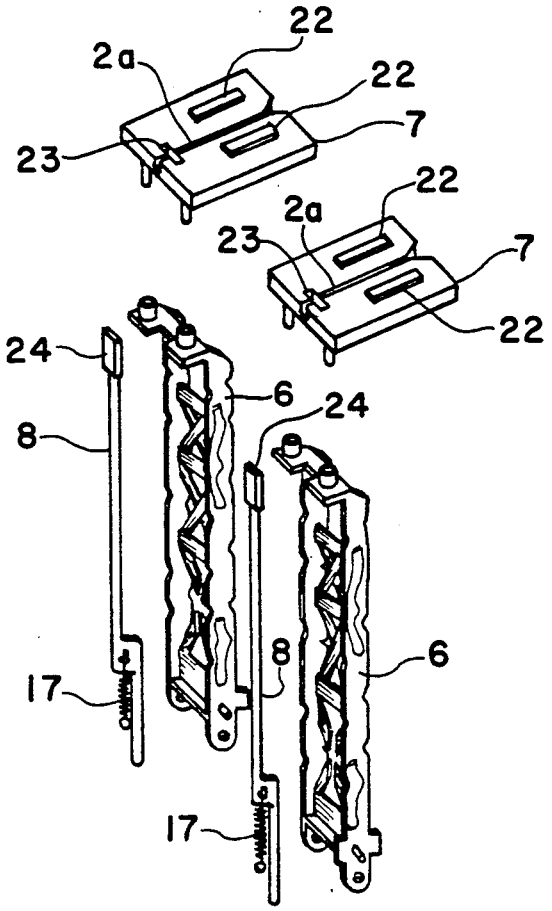
FIG. 3 is an enlarged, partial exploded view of a portion of the embodiment of FIG. 1.

Referring to FIG. 3, each stand 7 is mounted on a distal end of the pivotal arms 6 and has a central guide slot 2*a* which is rounded at the outer end. Magnetic strips 22 are provided on opposite sides of the guide slots 2*a* at the same width apart as the conductors 2 provided on opposite sides of slots 4. A pair of magnetic strips 22 for a pivotal arm 6 will attract a magnet 27 provided in the racing car 26.

Figure 4:
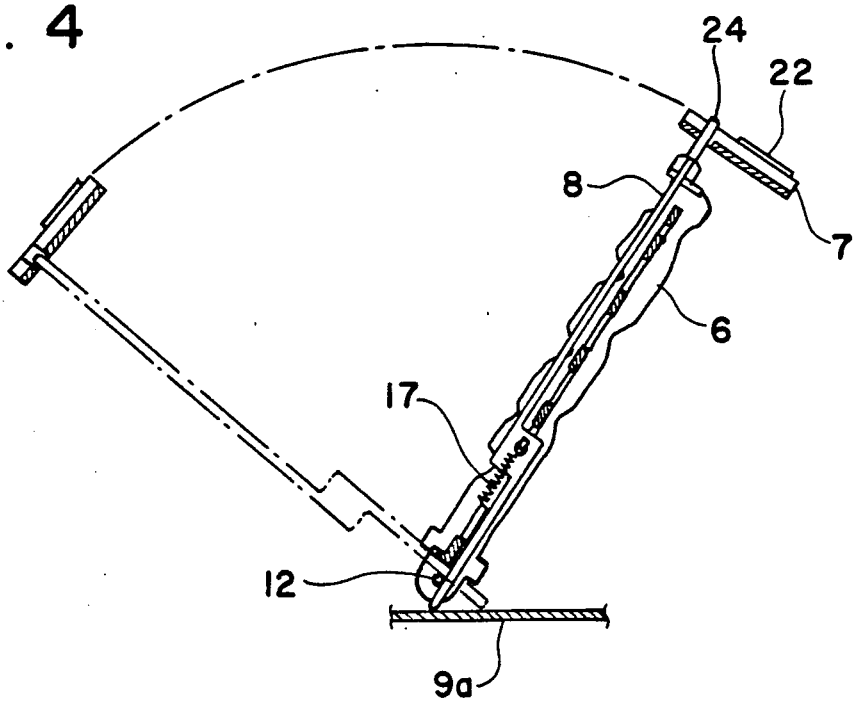
FIG. 4 is a partial side elevation view showing pivotal movement between two positions of the pivoting arm of the embodiment of FIG. 1.

A through hole 23 is formed at a forward portion of each stand 7 to receive a stopper 24, as will be described below. Each stand 7 is substantially coplanar with the other and angularly moves independent of each other in parallel paths to each other between a first or starting position as illustrated in FIG. 1, where the stand is in line with the inside end of the car-entry track portion 28, and a second or end position, where the stand is in line with the inside end of the car-exit portion 29. The range of angular movement is illustrated in FIG. 4.

Each pivotal arm 6 supports a sliding rod 8 which extends longitudinally. The aforementioned stopper 24 is formed on the distal end of each sliding rod 8 so as to freely move in or out of the through hole 23. Each sliding rod has a stub 8*a* (FIG. 2) mounting one end of tension springs 17, while the opposite end of each tension spring 17 is mounted on a stub 6*a* formed on a lower portion of the two pivotal arms 6. The springs bias the sliding rods 8 towards the lower portion of the respective pivotal arms. The proximal ends of the sliding rods 8 will thus be in contact with the bottom plate 9*a* of the supporting structure 9.

Figure 6:
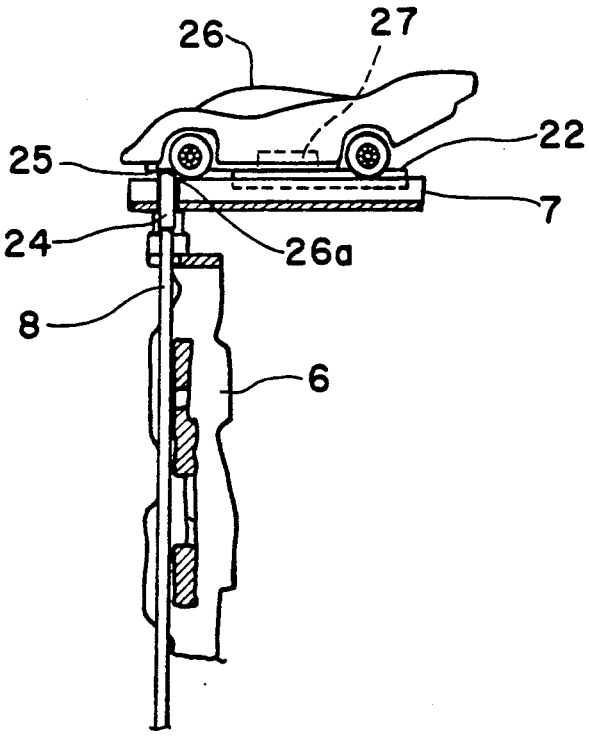
FIG. 6 is a side elevational view of a toy racing car on the stand of the embodiment of FIG. 1.

As shown in FIG. 6, a chassis of the racing car 27, shown on the stand 7, supports current collecting shoes or brushes 25 at a forward portion of the car 27, and further supports the magnet 27. The magnet 27 attracts the magnetic strips 22 disposed on each stand 7 so as to allow the racing car 26 to be held magnetically thereon. Although there is specific provision for a magnet 27, it is possible in an alternative embodiment to use instead the magnetic force of the magnets of the car's electric motor which is mounted on the chassis.

As aforementioned, the car-entry track portion 28 extends longer and at a larger gradient. The racing car 26 runs into the track portion 28 from an attached track at a high speed and comes to the stand 7, where it is stopped by the stopper 24. The pivotal arm 6 is then inertially forced to pivot from the first position to the second position due to the momentum of the car 26. The car's momentum carries the car and its pivotal arm 6 to the car-exit track portion 29. After passing the apex of its angular movement path, the cars weight and the weight of the pivotal arm 6 help complete the angular movement to the inner end of the car-exit track portion 29. At this position, the pivotal arm 6 is angled towards the car-exit track portion 29 to a greater degree from vertical than it was originally inclined towards the car-entry track portion 28. As shown in FIG. 4, this greater angle permits the sliding rod 8 to slide further downwardly, thereby retracting the stopper 24 from the stand 7. Thus, with the front end of the stand 7 in abutment with the inner end of car-exit track portion 29, the car 26 will pass from the stand to the car-exit track portion 29.

Each slot 4 of the car-exit track portion 29 has a V-shaped cut-away portion 3 on the inner end thereof so as to guide the guide pin 26*a* of the racing car 26.

When the pivoting arm 6 has pivoted so as to move the stand 7 into abutment with the inner end of the car-exit track portion 29, the coil springs 18 are caused to be tensioned by expanding the distance between the spring ends 19 and 29. This is due to the fact that upon counterclockwise movement of the arm 6, the ends 19 and 20 of each spring abut pin 21 of the lever 13 and pin 15 of the pivotal arm 6, respectively. This creates a return-spring bias which causes the pivotal arm 6 to pivot back to its original position depicted in FIG. 1 after the stand 7 has made contact with the car-exit track portion 29. This feature can be better understood referring to FIG. 5. The ends 19 and 20 of the spring 18 normally retain the projecting portion 16 in an orthogonal position relative to the pivotal arm 6. Once the arm 6 has moved to the right (clockwise) to a disposition of less than 90°, the weight of the arm will cause the stand 7 to rest against the forward, inner end of the car-entry track portion 28. Thus, the springs 18 need only move the arm 6 clockwise to a point less than 90°, or to the right of vertical. When the arm 6 moves counterclockwise due to the momentum of the car 26, the lever 13 pivots with arm until the projecting portion 16 contacts abutment 30, whereupon the lever is prevented from further rotation. As the arm continues to rotate the angle between the arm 6 and the projecting portion 16 becomes increasingly obtuse, and the spring tension in the coil springs 18 builds.

As further evidenced by FIG. 5, no spring force is developed for the first few degrees of angular movement until the projection portion 16 contacts the abutment 30. For the next few degrees, no spring force is developed until pin 21 contacts spring end 19 and pin 15 abuts spring end 20. This occurs when the arm is nearly vertical, but not quite. Thereafter, spring force is developed to cause the return of the arm 6. The aforementioned arrangement prevents excessive spring force which would exceed the inertial arm pivoting force and thereby prevent the car from passing from the car-entry to the car-exit tract portion 29.

The many features and advantages of the present invention are apparent from the detailed specification, and thus, it is intended by the appended claims to cover all such features and advantages of the track or rail apparatus of a racing car toy which fall within the true spirit and scope of the invention. Further, since numerous modifications and changes will readily occur to those skilled in the art based upon the disclosure herein, it is not desired to limit the invention to the exact construction and operation illustrated and described. Accordingly, all suitable modifications and equivalents may be resorted to, falling within the scope and the spirit of the invention.

What is claimed:

1. A track apparatus for a toy racing car comprising:

a track support body having a car-entry track portion at one end and a car-exit track portion at the opposite end;

at least one pivotal arm means pivotally movable between a first position juxtaposed the car-entry track portion and a second position juxtaposed the car-exit track portion, and being movable between the first and second positions by momentum of a toy racing car, and having a distal end and a proximal end pivotally connected to the track support body between the car-entry track portion and the car-exit track portion;

a stand connected to the distal end of each at least one pivotal arm means;

means associated with the stand for transferring the momentum of the car to each at least one pivotal arm means to thereby cause pivotal movement of each at least one pivotal arm means from the first to the second position; and means for returning each at least one pivotal arm means to the first position after pivotal movement to the second position, wherein the stand includes magnetic material and the car includes a magnet to magnetically steady the car on the stand.

2. A track apparatus according to claim 1, wherein the at least one pivotal arm means comprises two parallel, separately pivotal arm means, and wherein the car-entry track portion and the car-exit track portion each have two slots, the slots of each track portion being longitudinally aligned to define first and second car paths which are respectively centered on the stands of the two pivotal arm means.

3. A track apparatus according to claim 1, wherein the car-entry track portion and the car-exit track portion each have inner ends which oppose each other, and wherein the stand is aligned with an inner end of the car-entry track portion when the at least one pivotal arm means is in the first position, and is aligned with an inner end of the car-exit track portion when the at least one pivotal arm means is in the second position.

4. A track apparatus according to claim 1, wherein the transferring means comprises a stop means projectable upwardly from the stand in the first position to stop the car after passing from the car-entry track portion and retractable out of the stand in the second position to release the car onto the car-exit track portion.

5. A track apparatus according to claim 4, wherein the stop means is automatically retractable by movement of the at least one pivotal arm means.

6. A track apparatus according to claim 5, wherein the stop means further comprises a slidable rod mounted on the at least one pivotal arm means and having a proximal end and a distal end, a stopper integrally formed on the distal end and being movable between retracted and extended positions through a hole provided in a forward portion of the stand, and a spring biasing the slidable rod downwardly towards the track support body.

7. A track apparatus according to claim 6, wherein the track support body has a support structure between the car-entry track portion and the car-exit track portion which includes a bottom plate, the bottom plate having an upper surface which coacts with the proximal end of the slidable rod to move the stopper into and out of the retracted and extended positions.

8. A track apparatus according to claim 1, wherein the returning means comprises spring return means.

9. A track apparatus according to claim 8, wherein the spring return means comprises a pair of coil springs which wind upon pivotal movement of the pivotal arm means from the first position to the second position, and unwind to provide a return force to restore the pivotal arm means to the first position.

10. A track apparatus according to claim 1, wherein the car-entry track portion is longer and higher than the car-exit track portion.

11. A track apparatus for a toy racing car comprising:

a track support body having a car-entry track portion at one end and a car-exit track portion at the opposite end; and pivotal means disposed between the car-entry and car-exit track portions, and including:

first and second pivotal arms pivotally movable independently of each other between a first position juxtaposed the car-entry track portion and a second position juxtaposed the car-exit track portion, each pivotal arm being pivotally movable between the first and second positions by impulse imparted by a toy racing car corresponding travelling on each pivotal arm, means for stopping the car from moving on the pivotal means and for releasing the car when the pivotal arm associated with the car reaches the second position, each pivotal arm having a distal end and a proximal end pivotally connected to the track support body;

first and second stands connected respectively to the first and second pivotal arms;

means associated with each stand for transferring the momentum of a corresponding car to the first and second pivotal arms to thereby cause pivotal movement of each from the first to the second position;

means for returning the first and second pivotal arms to the first position after pivotal movement to the second position; and each of the stands including magnetic material and the car including a magnet to magnetically steady the car on a respective one of the stands.

12. A track apparatus for a toy racing car comprising:

a track support body having a car-entry track portion at one end and a car-exit track portion at the opposite end;

pivotal means including at least one pivotal arm pivotally movable between a first position juxtaposed the car-entry track portion and a second position juxtaposed the car-exit track portion, and being movable between the first and second positions by momentum of a toy racing car, and having a distal end and a proximal end pivotally connected to the track support body between the car-entry track portion and the car-exit track portion;

a stand connected to the distal end of each at least one pivotal arm;

means associated with the stand for transferring the momentum of the car to each at least one pivotal arm to thereby cause pivotal movement of each at least one pivotal arm from the first to the second position; and means for returning each at least one pivotal arm to the first position after pivotal movement to the second position, wherein the transferring means comprises a stop means projectable upwardly from the stand in the first position to stop the car after passing from the car-entry track portion and retractable out of the stand in the second position to release the car onto the car-exit track portion, wherein the stop means is automatically retractable by movement of the at least one pivotal arm, and wherein the stop further comprises a slidable rod mounted on the at least one pivotal arm and having a proximal end and being movable between retracted and extended positions through a hole provided in a forward portion of the stand, and a spring biasing the slidable rod downwardly towards the track support body.

13. A track apparatus according to claim 12, wherein the at least one pivotal arm comprises two parallel, separately pivotal arms, and wherein the car-entry track portion and the car-exit track portion each have two slots, the slots of each track portion being longitudinally aligned to define first and second car paths which are respectively centered on the stands of the two pivotal arms.

14. A track apparatus according to claim 12, wherein the car-entry track portion and the car-exit track portion each have inner ends which oppose each other, and wherein the stand is aligned with an inner end of the car-entry track portion when the at least one pivotal arm is in the first position, and is aligned with an inner end of the car-exit track portion when the at least one pivotal arm is in the second position.

15. A track apparatus according to claim 12, wherein the track support body has a support structure between the car-entry track portion and the car-exit track portion which includes a bottom plate, the bottom plate having an upper surface which coacts with the proximal end of the slidable rod to move the stopper into and out of the retracted and extended positions.

16. A track apparatus according to claim 12, wherein the returning means comprises spring return means.

17. A track apparatus according to claim 16, wherein the spring return means comprises a pair of coil springs which wind upon pivotal movement of the pivotal arm from the first position to the second position, and unwind to provide a return force to restore the pivotal arm to the first position.

18. A track apparatus according to claim 12, wherein the stand includes magnetic material and the car includes a magnet to magnetically steady the car on the stand.

19. A track apparatus according to claim 12, wherein the car-entry track portion is longer and higher than the car-exit track portion.

20. A track apparatus for a toy racing car comprising:

a track support body having a car-entry track portion at one end and a car-exit track portion at the opposite end;

at least one pivotal arm means pivotally movable between a first position juxtaposed the car-entry track portion and a second position juxtaposed the car-exit track portion, and being movable between the first and second positions by momentum of a toy racing car, and having a distal end and a proximal end pivotally connected to the track support body between the car-entry track portion and the car-exit track portion;

a stand connected to the distal end of each at least one pivotal arm means;

means associated with the stand for transferring the momentum of the car to each at least one pivotal arm means to thereby cause pivotal movement of each at least one pivotal arm means from the first to the second position;

means for returning each at least one pivotal arm means to the first position after pivotal movement to the second position, wherein the car-entry portion is longer and higher than the car-exit track portion; and the stand including magnetic material and the car including a magnet to magnetically steady the car on the stand.

21. A track apparatus for a toy racing car comprising:

a track support body having a car-entry track portion at one end and a car-exit track portion at the opposite end;

at least one pivotal arm means pivotally movable between a first position juxtaposed the car-entry track portion and a second position juxtaposed the car-exit track portion, and being movable between the first and second positions by impulse imparted by a toy racing car, and having a distal end and a proximal end pivotally connected to the track support body between the car-entry track portion and the car-exit track portion, means for stopping the car from moving on the pivotal arm means and for releasing the car when the pivotal arm means associated with the car reaches the second position;

a stand connected to the distal end of each at least one pivotal arm means;

means associated with the stand for transferring the momentum of the car to each at least one pivotal arm means to thereby cause pivotal movement of each at least one pivotal arm means from the first to the second position;

means for returning each at least one pivotal arm means to the first position after pivotal movement to the second position; and the stand including magnetic material and the car including a magnet to magnetically steady the car on the stand.

22. A track apparatus for a toy racing car comprising:

a track support body having a car-entry track portion at one end and a car-exit track portion at the opposite end;

pivotal means including at least one pivotal arm pivotally movable between a first position juxtaposed the car-entry track portion and a second position juxtaposed the car-exit track portion, and being movable between the first and second positions by momentum of a toy racing car, and having a distal end and a proximal end pivotally connected to the track support body between the car-entry track portion and the car-exit track portion;

a stand connected to the distal end of each at least one pivotal arm;

means associated with the stand for transferring the momentum of the car to each at least one pivotal arm to thereby cause pivotal movement of each at least one pivotal arm from the first to the second position; and means for returning each at least one pivotal arm to the first position after pivotal movement to the second position, wherein the transferring means comprises a stop means projectable upwardly from the stand in the first position to stop the car after passing from the car-entry track portion and retractable out of the stand in the second position to release the car onto the car-exit track portion, wherein the stand includes magnetic material and the car includes a magnet to magnetically steady the car on the stand.

* * * * *